US007922149B2

(12) United States Patent
Anderson et al.

(10) Patent No.: US 7,922,149 B2
(45) Date of Patent: Apr. 12, 2011

(54) DAMPER ACTUATOR ASSEMBLY

(75) Inventors: Dean B. Anderson, Wonder Lake, IL (US); Guy P. Caliendo, Algonquin, IL (US); Wendy Perna, Grayslake, IL (US); Matthew D. Cook, Lake Villa, IL (US)

(73) Assignee: Siemens Industry Inc., Alpharetta, GA (US)

( * ) Notice: Subject to any disclaimer, the term of this patent is extended or adjusted under 35 U.S.C. 154(b) by 1064 days.

(21) Appl. No.: 11/169,523

(22) Filed: Jun. 29, 2005

(65) Prior Publication Data

US 2006/0035580 A1 Feb. 16, 2006

Related U.S. Application Data

(60) Provisional application No. 60/584,254, filed on Jul. 29, 2004.

(51) Int. Cl.
*F16K 31/02* (2006.01)

(52) U.S. Cl. ..... 251/129.01; 137/79; 137/468; 454/369

(58) Field of Classification Search ..... 137/79, 137/457, 468; 251/129.01; 236/49.2; 454/342, 454/357, 369
See application file for complete search history.

(56) References Cited

U.S. PATENT DOCUMENTS

| | | | | |
|---|---|---|---|---|
| 2,522,235 | A * | 9/1950 | Moore | 285/154.4 |
| 5,349,983 | A * | 9/1994 | Ozarowski et al. | 137/487.5 |
| 5,975,486 | A * | 11/1999 | Dettmann | 251/30.02 |
| 6,286,537 | B1 * | 9/2001 | Backham et al. | 137/79 |
| 7,156,121 | B2 * | 1/2007 | Cox et al. | 137/554 |

OTHER PUBLICATIONS

Molex Micro-Fit 3.0 Datasheet, 1999.*

* cited by examiner

*Primary Examiner* — John K Fristoe, Jr.

(57) ABSTRACT

A damper actuator assembly comprises an actuator and an electronic fusible link (EFL) connected by at least one wire. The actuator comprises an actuator housing with actuator leads extending from the actuator housing. The actuator leads include a first quick connect positioned on an end of the actuator lead. A flexible conduit material covers the actuator lead. The EFL comprises an EFL housing which is separate from the actuator housing. The EFL housing includes a quick connect seat and an integral conduit adaptor. A second quick connect is positioned on an end of the EFL lead. When the end of the flexible conduit material that includes the actuator lead and first quick connect is inserted into the integral conduit adaptor of the EFL housing, the first quick connect is coupled to the second quick connect and an electrical connection is established between the actuator and the EFL.

18 Claims, 7 Drawing Sheets

DAMPER ACTUATOR ASSEMBLY

CROSS-REFERENCE TO RELATED APPLICATIONS

This application claims the benefit of earlier filed U.S. provisional patent application No. 60/584,254, filed Jul. 29, 2004.

BACKGROUND

This invention relates to the field of building control systems, and more particularly, to ventilation and life safety dampers for use in building control systems.

Building control systems control various aspects of a building and include features directed to comfort, safety, lighting and other aspects. With respect to comfort, one aspect of a building control system includes heating, ventilation and air conditioning (HVAC). An HVAC system involves conditioning of the air within an area, zone or room (collectively, a "room"). Such conditioning includes providing heated air, cooled air, fresh air, circulated air and/or the like to the particular room depending on various factors. The HVAC system includes a system of ducts that terminate in particular rooms. The termination points are controlled by ventilation dampers or damper systems. Each ventilation damper/damper system is operative to open and close to control the flow of air through the respective termination point and into a room. Accordingly, ventilation dampers/dampers systems (collectively, "dampers") are used for temperature control, pressure regulation, air circulation and/or replacement of stale air within the rooms of a building.

Basic two-position dampers are positionable into either a fully opened or a fully closed position. This two-position system provides for either full air flow or no air flow into a room. Modulated dampers are also available. Modulated dampers are positionable in many intermediate positions between open and closed. These intermediate positions can be advantageous when attempting to maintain the temperature in a room at a constant desired comfort level.

Many HVAC systems use only two-position dampers and do not incorporate modulated dampers. Other HVAC systems are designed with a combination of two-position dampers and modulated dampers. In these combination systems, the modulated damper is used for comfort control such as regulating the temperature in the associated room. In both systems, the two-position damper may be used as safety feature in the event of fire and smoke. In particular, in certain situations it may be advantageous to vent heat and smoke away from a room. In other situations, it may be advantageous to seal a room to avoid fanning existing flames. Fire safety codes typically do not allow for modulated operation in the presence of smoke or fire in order to ensure basic operation of the damper. Thus, even if buildings include modulated dampers, they must also include two position fire and smoke safety dampers.

The two-position fire and smoke control damper generally employs a two-state actuator control operable to open or close the damper. Because operation of the actuator is critical in the event of a fire, these actuators must be designed with high temperature operation requirements. The two-position damper generally includes power supply circuitry, motor control circuitry, an electric motor, and a actuator/damper interface. The power supply circuitry receives AC or DC input, transforms the input, if appropriate, and delivers power to the motor control circuitry. The motor control circuitry generally passes the appropriate power on to the electric motor, causing an interface adaptor from the actuator to deliver an appropriate torque to the actuator/damper interface. The actuator/damper interface is simply a gear arrangement or other mechanism or component used to join the output shaft of the actuator to the damper operator mechanism which is operable to open or close louvers of the damper. Accordingly, the actuator must be positioned on or near the damper to allow the actuator/damper interface to connect to the damper operator mechanism.

The two position fire safety damper must also default to a closed position if heat conditions exceed that which allow for reliable operation of the electrical control circuitry. To this end, the actuator for the two-position fire control damper is generally used in association with an electronic fusible link ("EFL"). The EFL includes a temperature sensor and an associated switch. The EFL is operable to disable power to the actuator in the event the temperature in the duct exceeds a certain predetermined set point. Accordingly, the temperature sensor of the EFL must be positioned within or in close proximity of the air duct to allow the temperature sensor to monitor the air temperature within the duct.

In order to connect the actuator to the EFL, the EFL switch is electrically coupled in series with the main power lines (or other building power lines) and the actuator. To this end, electrical leads generally extend from at least the EFL which have to be stripped and connected to the power lines on one end and to the actuator on the other end. However, because of the confined working space typically available to HVAC technicians, it is difficult for the technicians to strip the various wire leads and join them together. Therefore, it would be advantageous to provide an actuator assembly wherein the actuator and EFL are easily connected once they are mounted in an HVAC system.

In order to protect the wire leads extending between the actuator and the EFL from physical damage, a flexible conduit material is often placed around the leads. The flexible conduit material preferably extends from the actuator housing to the EFL housing. When properly placed around the leads, the flexible conduit material helps protect the leads from outside environmental influences, such as heat, cold, water, and third parties working near the HVAC system. However, as mentioned previously, limited space is typically available to the HVAC technician, and this makes placement of this flexible conduit material around the leads difficult once the actuator and EFL are mounted. Accordingly, it would be desirable to provide an actuator arrangement wherein flexible conduit material may be easily joined between the actuator housing and the EFL housing.

SUMMARY

A damper actuator assembly comprises an actuator and an EFL connected by at least one wire. The actuator comprises an actuator housing with a motor positioned in the housing. The motor configured to control a ventilation damper connected to the assembly between an open position and a closed position. The actuator further comprises actuator circuitry positioned within the actuator housing and connected to the motor. The actuator circuitry includes power supply circuitry, motor control circuitry, and actuator leads extending from the actuator housing. The actuator leads include a first quick connect positioned on an end of the actuator leads.

The EFL of the damper actuator assembly comprises an EFL housing which is separate from the actuator housing. EFL temperature sensor and switch are positioned in or on the second housing. The EFL includes a second quick connect positioned on or in the EFL. The second quick connect is configured to engage the first quick connect and establish an electrical connection between the actuator and the EFL.

In one embodiment, the second quick connect is secured to the EFL housing in a quick connect seat. The actuator leads extend away from the actuator and to the EFL housing, where the first quick connect is coupled to the second quick connect. In this embodiment, the actuator leads may be covered by a flexible conduit material, and the EFL housing may include an integral conduit adaptor designed to receive the flexible conduit material. When the end of the flexible conduit material which retains the first quick connect and leads is inserted into the integral conduit adaptor of the EFL housing, the first quick connect is joined to the second quick connect, thus establishing an electrical connection between the actuator leads and the EFL lead.

In another embodiment, a damper actuator assembly comprises an actuator having a first power input for receiving power for operating actuator circuitry, the actuator circuitry including at least a first circuit and a motor circuit operably coupled to the first power input, the actuator including an actuator housing. In another embodiment, a damper actuator assembly comprises an actuator having a first power input for receiving power for operating actuator circuitry, the actuator circuitry including at least a first circuit and a motor circuit operably coupled to the first power input, the actuator including an actuator housing; and an EFL disposed external to the actuator housing and including (i) an EFL housing including a conduit adaptor configured to accept a flexible conduit positioned around the pre-wired actuator leads, and (ii) a switch coupled to operably disconnect power from the motor circuit without disconnecting the first circuit.

In another embodiment, a damper actuator assembly includes an actuator and an EFL operably coupled to disconnect the motor of the actuator without necessarily disconnecting other circuits. The EFL is associated with low voltage circuitry of the actuator. Accordingly, the EFL may be manufactured with less expensive low-voltage components compared to EFLs associated with higher voltage circuitry. The low-voltage components used in the EFL are also very reliable.

In one embodiment, the EFL housing includes a base portion and a duct finger. The base portion is designed for mounting inside or outside of an air duct and the integral conduit acceptor is formed in the base portion. The duct finger is designed to mount inside of the air duct, and the temperature sensor is mounted on the duct finger.

DESCRIPTION

Figure 1:
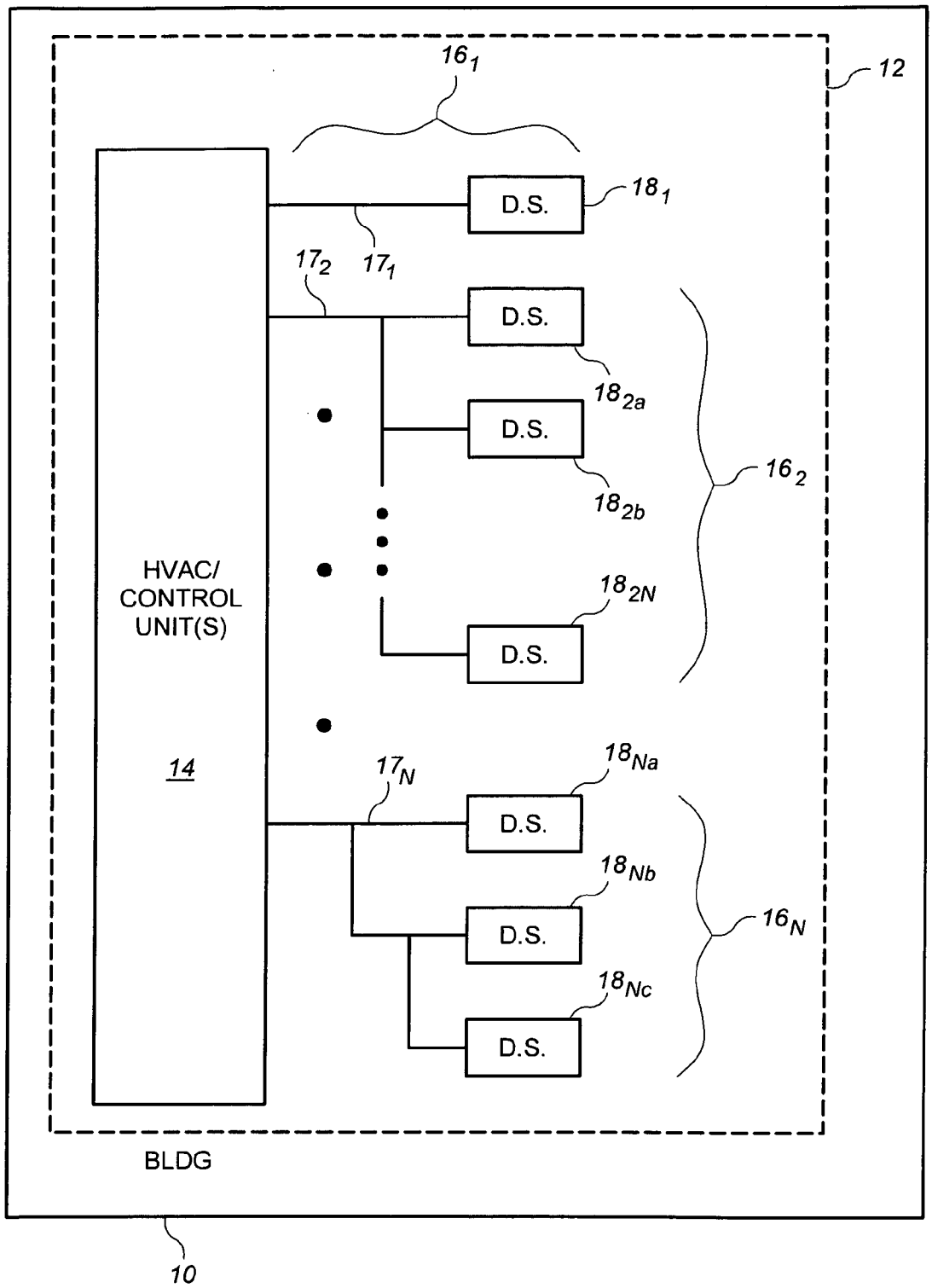
FIG. 1 shows a block diagram representation of a typical building having an HVAC/control system including a ventilation damper system.

With reference now to FIG. 1, there is depicted a representation of a building generally designated 10 in which the actuator damper assembly described herein may be used. It should be appreciated that the building 10 is representative of any structure that has a ventilation system or systems such as a house, multi-story building or the like. The building 10 has a ventilation/ventilation control system such as an HVAC/control system 12 having various HVAC and control components. The HVAC/control system 12 includes an HVAC/control unit(s) 14 representative of heating, air conditioning, and/or other ventilation sources, components, systems, equipment and/or the like as are well known in the art.

As is typical, the HVAC/control system 12 includes a plurality of air flow/control systems generally designated $\mathbf{16}_1$, $\mathbf{16}_2$ through $\mathbf{16}_N$ that direct the flow of air from the HVAC units to various places in the building 10 and which thereafter control the flow of air into the various places. Such places may be rooms, zones, areas or the like. Each air flow/control system $\mathbf{16}_1$, $\mathbf{16}_2$ through $\mathbf{16}_N$ is characterized by a series of air ducts or ductwork and communication/control lines both of which are concurrently represented by lines $\mathbf{17}_1$, $\mathbf{17}_2$ through $\mathbf{17}_N$. Each line $\mathbf{17}_1$, $\mathbf{17}_2$ through $\mathbf{17}_N$ terminates in at least one damper system 18 (also labeled as "D.S." in FIG. 1). Each damper system 18 provides adjustable control of air flow from the lines $\mathbf{17}_1$, $\mathbf{17}_2$ through $\mathbf{17}_N$ into the particular rooms of the building 10, particularly under control of the control system(s).

The air ducts or ductwork provide passageways for directing air flow from the HVAC units(s) 14 to various rooms of the building 10. Shown in FIG. 1 for illustrative purposes, are various exemplary manners in which the ducts may be configured and/or terminated. Particularly, the system $\mathbf{16}_1$ has a single duct $\mathbf{17}_1$ that terminates in a single damper system $\mathbf{18}_1$. The system $\mathbf{16}_2$ has a duct system $\mathbf{17}_2$ that has various branches from a main duct thereof, each of which terminates in a damper system $\mathbf{18}_{2a}$, $\mathbf{18}_{2b}$ through $\mathbf{18}_{2N}$. The system $\mathbf{16}_N$ has a variable branch duct system that terminates in damper systems $\mathbf{18}_{Na}$, $\mathbf{18}_{Nb}$ and $\mathbf{18}_{Nc}$.

Figure 2:
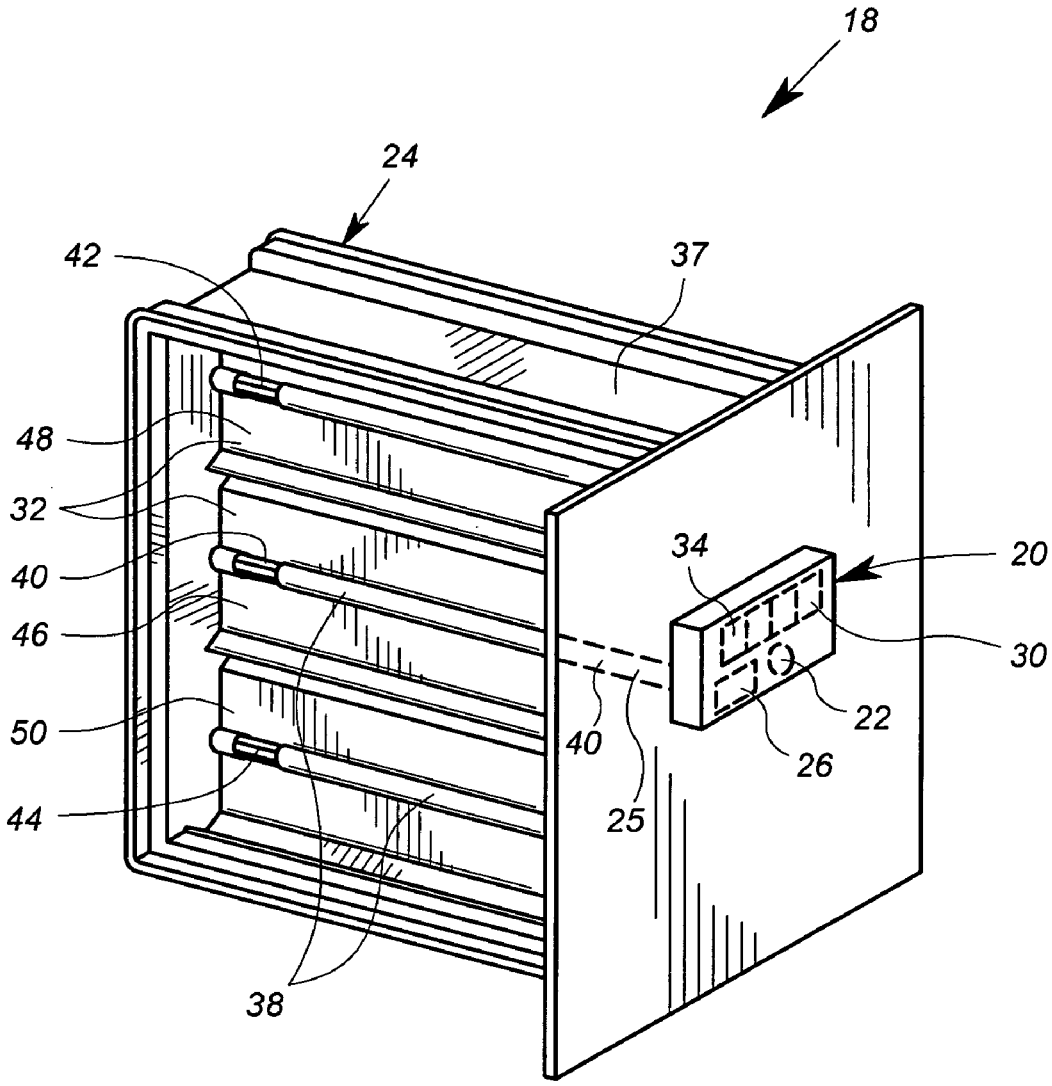
FIG. 2 shows a perspective view of an exemplary damper system of FIG. 1.

Referring now to FIG. 2, there is depicted an exemplary damper system 18 having an exemplary damper 24 to which is attached a damper actuator 20. The damper 24 includes a frame 37 and a plurality of adjustable vanes, blades, louvers or the like 32. Each vane 32 is connected to a rotatable shaft 38. The damper 24 also includes a damper blade control 25. In FIG. 2 the exemplary damper blade control 25 is a control shaft 40. The control shaft 40 is mechanically coupled to an upper shaft 42 and a lower shaft 44 such that rotation of the control shaft 40 also rotates the upper shaft 42 and the lower shaft 44.

The control shaft 40 is coupled to a vane, blade, louver or the like 46 such that rotational movement of the control shaft 40 rotates the vane 46 about the control shaft 40. The upper shaft 42 is coupled to a vane, blade, louver or the like 48 such that rotational movement of the upper shaft 42 rotates the vane 48 about the upper shaft 42. The lower shaft 44 is also coupled to a vane, blade, louver or the like 50 such that rotational movement of the lower shaft 44 rotates the vane 50 about the lower shaft 44. Thus, rotation of the control shaft 40 rotates the vane 46 as well as the upper and lower shafts 42, 44 which, in turn, rotate the vanes 48 and 50. As the vanes 46, 48 and 50 rotate, they open up the damper 24 and allow air to flow of therethrough. The damper 24 is thus operable to be controlled to provide a fully open position, a fully closed position, and, if applicable, positions intermediate the fully open and fully closed positions through controlled rotation of the control shaft 40.

It should be appreciated that the damper 24 in FIG. 2 is depicted in the fully closed position. In this position, the vanes 46, 48 and 50 are perpendicular to the flow of air through the damper 24 and thus the vanes prevent the flow of air past the damper. A fully open position has the vanes 46, 48 and 50 parallel to the flow of air through the damper 24. The intermediate positions have the vanes 46, 48 and 50 at a rotational angle between perpendicular and parallel. It should be appreciated that the damper 24 is only exemplary of a style or type of damper and that other styles, configurations and/or types of dampers may be utilized. The damper 24 of FIG. 2, however, provides an illustration of the manner in which the dampers control the flow of air therethrough.

The actuator 20 attached to the damper 24 is operable to control the damper 24. As explained in further detail below, the damper actuator 20 houses a motor 22, a motor/damper interface 26, and other actuator components. The actuator 24 is attached to the damper such that the motor/damper interface 26 is connected to the damper control 25. In the exemplary embodiment of FIG. 2, the motor/damper interface 26 is connected to the control shaft 40 of the damper 24. Accordingly, the actuator is operable to rotate the motor 22 and control the motor/damper interface 26 and connected control shaft 40 on the damper 24. By controlling the control shaft 24, the actuator is operable to control the vanes 32 of the damper between an open and a closed position.

Figure 3:
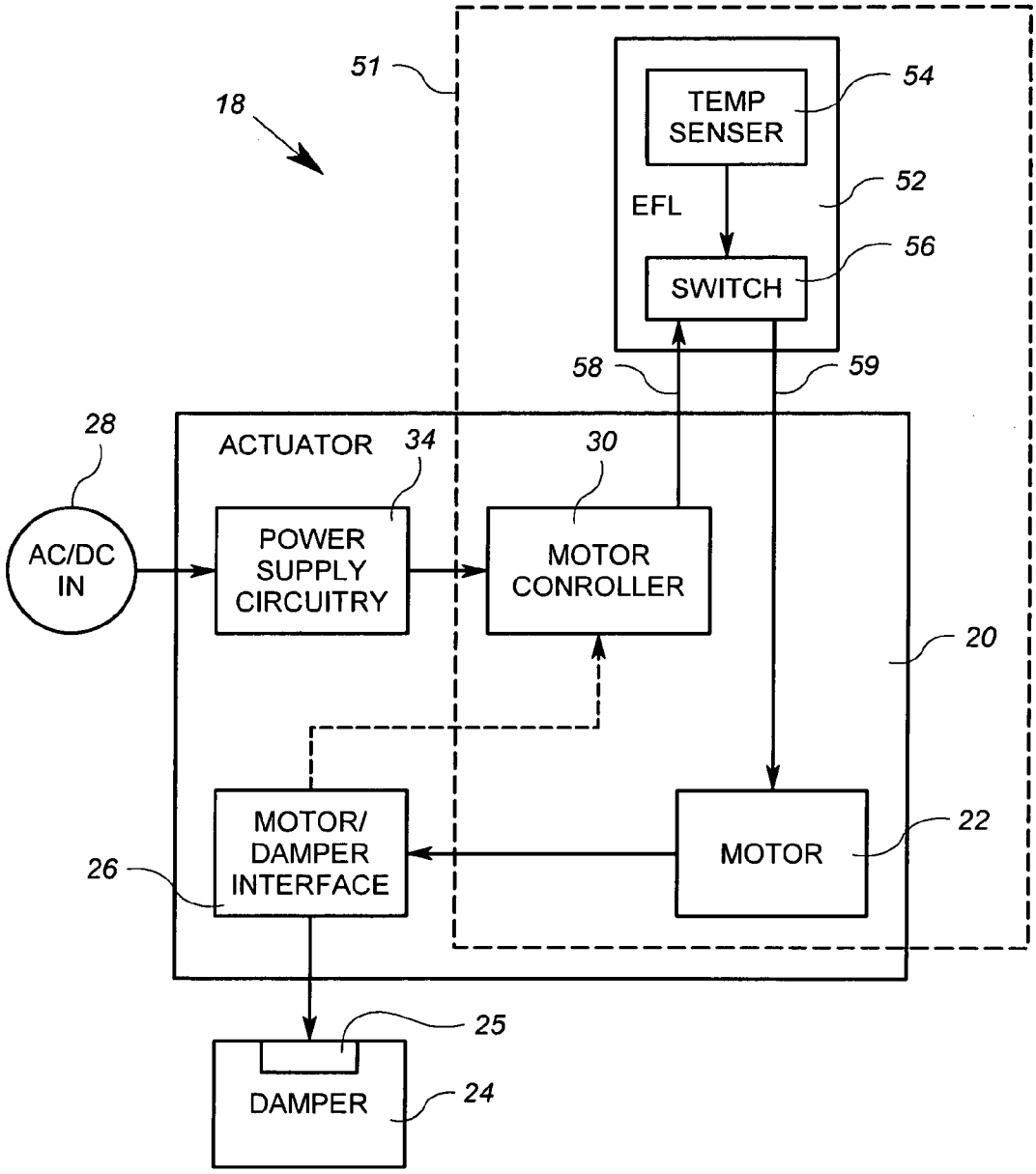
FIG. 3 shows a block diagram of an actuator and EFL of the ventilation damper system of FIG. 1.

Referring now to FIG. 3, there is depicted a block diagram of an exemplary damper system 18, including a damper 24, actuator 20 and an EFL 52. As described above, the actuator 20 is mounted in proximity of the damper control 25. The actuator includes a motor and a motor/damper interface. In one embodiment, the motor 22 is a brushless DC motor. Other types of motors both AC and DC, however, may be used such as a synchronous motor, a brush DC motor, a shaded pole motor and/or the like. The actuator 20 is configured to control the damper 24. Particularly, as described above, the motor/damper interface 26 of the actuator is connected to a damper control 25 positioned on the damper, and the damper control is operable to open or close the louvers of the damper 24. The motor/damper interface 26 translates the rotational motion of the motor 22 into motion that moves the damper control 25 and the associated louvers. In one embodiment, the motor/damper interface comprises a gear train operable to translate relatively fast rotation of the motor 22 into slower rotation of the damper control shaft 40.

In addition to the above, the actuator 20 further includes control circuitry, including a motor controller 30 and power supply circuitry 34. In one embodiment, the motor controller 30 is an advanced motor controller operable to move the louvers of the damper to multiple positions between open and closed. These types of motor controllers are also known as modulating controllers. In another embodiment, the motor controller 30 is a simple motor controller operable to move the louvers of the damper only between the open position and the closed position. These types of controllers are known as two-point controllers. The motor controller 30 is operable to provide control signals to the motor 22 that allow the motor 22 to provide precise control of the damper 24 through the motor/damper interface 26.

In one embodiment, position of the damper louvers between the open and closed positions is accomplished with the aid of motor position feedback, as represented by the arrow 36 emanating from the motor/damper interface 26 to the motor controller 30 in FIG. 3. The actuator 20 may have encoding or the like that provides the necessary feedback to determine rotational position of the damper interface 26. This rotational position may then be used by the motor controller 30 to determine damper position. For example, rotation of the motor a certain number of revolutions in one direction may move the damper into 50% of being open relative to a fully open or fully closed position (i.e. halfway between a fully open position and a fully closed position). As another example, each number of revolutions of the motor 22 may move the damper 24 a known amount. This ratio may be dependant on possible gearing internal to the actuator 20. In another embodiment, the position of the damper louvers may be accomplished in a time based manner. For example, applying a control signal of a given length from the motor controller 30 may be known to move the damper 24 a given amount. The time that the control signal is applied thus translates into movement of the damper. This may be accomplished in both rotational directions.

The power supply circuitry 34 of the actuator is configured to receive either AC or DC power (AC/DC IN) and provide appropriately conditioned AC or DC power to the motor controller 30 and motor 22. Thus, in one embodiment, the power supply circuitry 34 includes a transformer and circuit (not shown) for converting AC power from a power source 28 into DC power for delivery to the DC motor 22 of the actuator. The power source 28 may suitably be the building electrical mains power source, or a special building power line carrying electricity for building and/or emergency circuits.

As shown in FIG. 3, the motor controller 30 of the actuator is connected to an electronic fusible link (EFL) 52. The electronic fusible link includes a temperature sensor 54 and a switch 56. The temperature sensor 54 is generally arranged on the EFL such that the temperature sensor is exposed within the air duct when the EFL is mounted to the air duct. The temperature sensor is configured to determine whether the temperature within the air duct is above a predetermined threshold temperature. For example, the temperature sensor may be operable to send an electronic signal when the temperature in the air duct exceeds 165° F., 250° F., 350° F., or some other predetermined threshold temperature. When the temperature sensor 54 detects a temperature above the threshold, it sends a signal to the switch 56. The switch 56 is generally closed and provides a connection between the motor controller 30 and the motor 22 within the actuator. However, when the temperature sensor 54 detects a temperature in the air duct above the predetermined threshold, the switch 56 is opened and the power is cut off between the motor controller 30 and the motor 20. When power is cut off to the motor, an automatic return spring within the actuator moves the motor/damper interface, causing to the damper to move to the closed position. Use of such an automatic return spring when power is cut off from the motor is well known in the art.

As shown in FIG. 3, wires 58, 59 extend between the actuator and the EFL. These wires typically include leads of the actuator and leads of the EFL that must be connected to provide electrical power to the motor 22 of the actuator 20. It is noted that in contrast to prior art designs, the EFL switch in this embedment is connected to interrupt power to circuits within the actuator 20 itself, instead of merely disconnect main power from the entire actuator. For example, in FIG. 3, all components inside the box 51 shown with a dotted line are low-voltage components. As a result, a lower voltage and or power switch may be used in the EFL if desired, and circuits other than the motor within the actuator 20 may retain power if desired. In any event, as mentioned previously, flexible conduit material is often placed around these wires 58, 59 to protect them from environmental influences. As explained in further detail below, the actuator assembly described herein includes advantages and features to make connection between the actuator and EFL easier and more reliable. Furthermore, the actuator assembly described herein includes advantages and features to make placement of a flexible conduit material around wires 58 and 59 easier for the technician.

Figure 4:
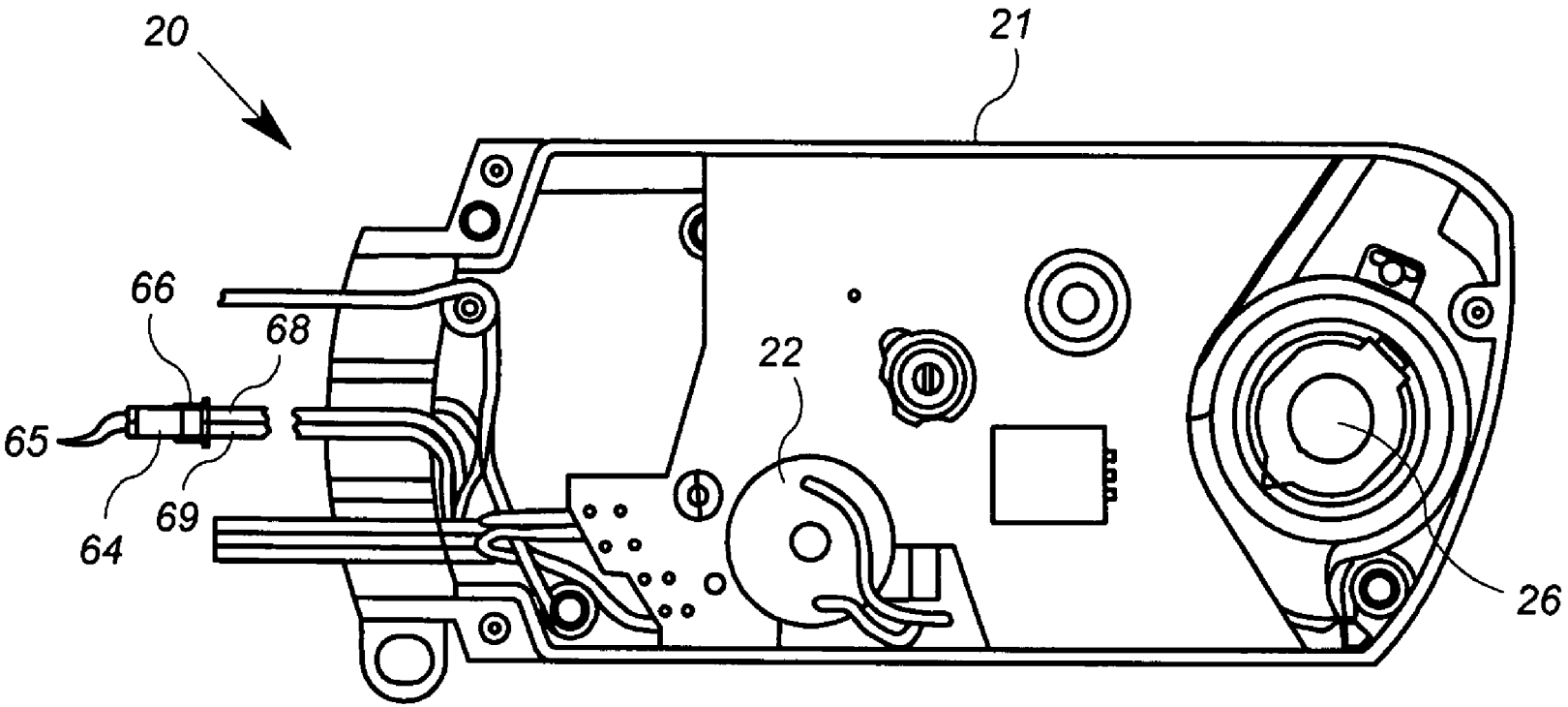
FIG. 4 shows a side cutaway view of an exemplary actuator of a damper actuator assembly.

With reference now to FIG. 4, a side cutaway view of an actuator 20 is shown. The actuator 20 includes a motor 22 and a motor/damper interface 26 retained within an actuator housing 21. The actuator also includes two leads 68, 69 extending from the actuator housing 21. These actuator leads comprise the wires 58 and 59 of FIG. 3. The actuator leads 68, 69 are shown as broken in FIG. 4 as representative of leads that extend a distance from the housing. For example, the actuator leads may extend 1.5 feet, 5 feet, 10 feet or any other appropriate distance from the housing to allow the leads to reach to the EFL after the actuator 20 is mounted near the damper.

Attached to one end of the actuator leads 68, 69 is a quick connect. The quick connect is an electrical connector attached to the end of one or more wires. The quick connect is designed to mate with a complimentary quick connect of the EFL and establish an electrical connection between the wires attached to the complimentary quick connects. An example of such a quick connect is the Molex Microfit Terminal from Molex, Inc. of Lisle, Ill.

In one embodiment, as shown in FIG. 4, a first quick connect 64 includes one or more exposed contact prongs 65, a base portion 66, and snap receptacles formed on the base portion (not shown). The wires attached to the quick connect 64 are joined to the contact prongs within the base portion 66. The base portion 66 is generally comprised of an insulating plastic material with the wires and contact prongs partially encased in the plastic material.

Figure 5:
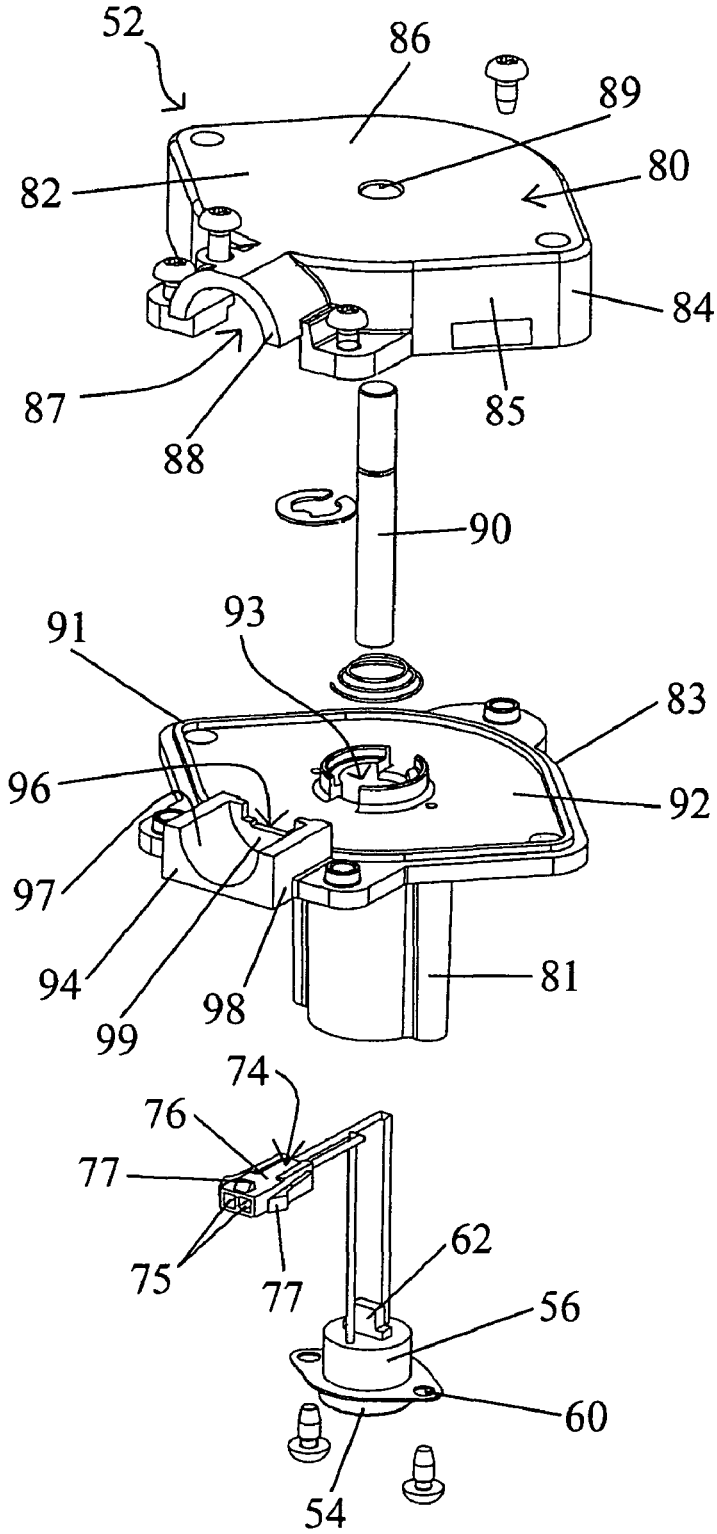
FIG. 5 shows an exploded perspective view of an EFL operable to be connected to the actuator of FIG. 4.

A second complimentary quick connect 74 may be viewed with reference to FIG. 5. In FIG. 5, the complimentary quick connect 74 includes two connection sockets 75, a base portion 76, and snap tabs 77. The connection sockets 75 are designed and dimensioned to receive the exposed contact prongs. The wires connected to the complimentary quick connect 74 are joined to the connection sockets 75 within the base portion 76. Again, the base portion 76 is comprised of an insulating plastic material and the connection sockets and wires are at least partially encased in the plastic material. The snap tabs 77 on the base portion 76 are resilient, allowing the tabs to snap into the snap receptacles on the base portion of the first quick connect when the prongs 65 of the first quick connect are inserted into the sockets 75 of the second quick connect. Complementary quick connects may generally be joined by inserting the prong end of one quick connect into the socket end of the complimentary quick connect until the snap tabs on one base portion snap into the snap receptacles on the other base portion.

With reference now to FIGS. 5-8, an EFL 52 comprises an EFL housing 80, a temperature sensor 54 and a switch 56. The EFL housing 80 includes a duct finger extension 81 and a base portion 82. The base portion is split into a platform 83 and an enclosure 84. The enclosure 84 generally includes a sidewall 85 and a top 86. An opening 87 is formed in the sidewall. The opening 87 is dimensioned to fit around a portion of a quick connect. A first conduit receiver portion 88 extends from the sidewall 85 about the opening 87. The first conduit receiver portion 88 is generally arch-shaped and is dimensioned to cover a portion of a flexible conduit material typically used to cover electrical wires. A center hole 89 is formed in the top 86. The center hole 89 is dimensioned to allow a portion of a pushbutton shaft 90 to pass through the center hole 89.

The platform 83 of the base portion 82 includes an outer lip 91 designed to fit within the sidewall 85 of the enclosure 84. The platform 83 also includes a bottom 92. A passage 93 is provided in the bottom 92 which provides an opening between the base portion 82 and the duct finger portion 81 of the EFL housing. A second conduit receiver portion 94 extends from the platform 83. The second conduit receiver portion 94 is generally arch-shaped in its interior surface 97 and is dimensioned to cover a portion of a flexible conduit material typically used to cover electrical wires. The exterior surface 98 of the second conduit receiver portion 94 is generally formed in a squared shape to provide strength for the structure. A quick connect opening 96 is also provided in a rear wall 99 of the second conduit receiver portion 94. The quick connect opening 96 is generally provided in the shape of a portion of a quick connect, such as quick connect 74.

Figure 7:
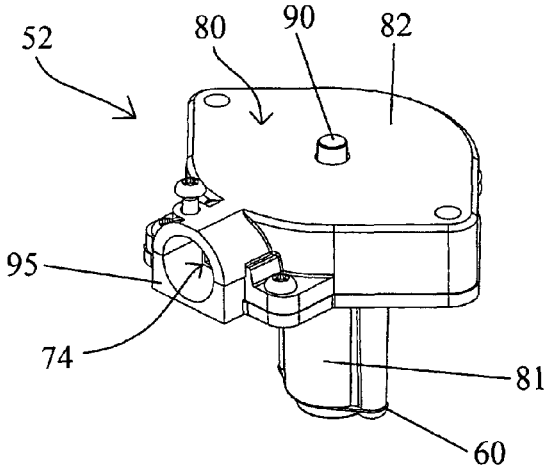
FIG. 7 shows an assembled perspective view of the EFL of FIG. 5.
Figure 8:
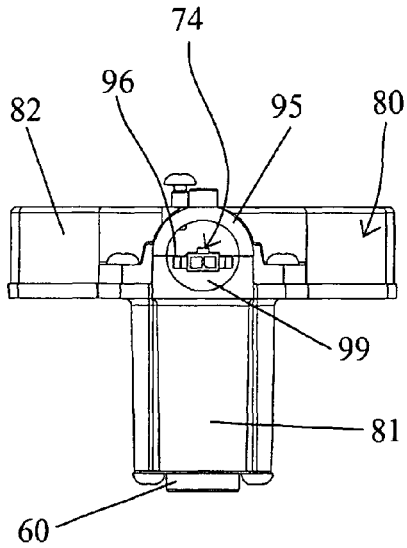
FIG. 8 shows a front view of the EFL of FIG. 5.

When the enclosure 84 of the base portion 82 is arranged over the platform 83 of the base portion, the first conduit receiver portion 88 comes together with the second conduit receiver portion 94 to form an EFL housing 80 having an integral conduit acceptor 95, as shown in FIGS. 7 and 8. The integral conduit acceptor 95 is generally circular in shape and is dimensioned to receive a flexible conduit designed to cover electrical wires. As shown in FIG. 8, a seat is established for the quick connect 74 in the rear wall 99 when the enclosure 84 of the base portion 82 is arranged over the platform 83. This seat is designed to securely hold the quick connect 74 and allow a complimentary quick connect 65 to join to the quick connect 74 when the complimentary quick connect is placed into the conduit acceptor 95.

Figure 6:
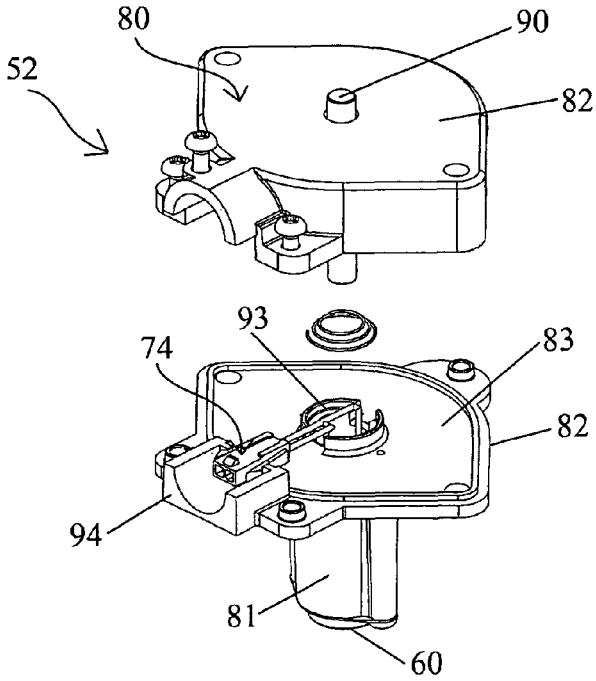
FIG. 6 shows a partially exploded perspective view of the EFL of FIG. 5.

The temperature sensor 54 and switch 56 of the EFL 52 are enclosed as a single component 60. The switch is typically a KLIXON INTO8L-3V-FC-177C from Texas Instruments of Dallas, Tex. In the embodiment of FIGS. 5-8, the component 60 is mounted to the EFL housing 80 such that the temperature sensor portion of the component 60 is exposed to the exterior of the EFL housing 80 and the switch portion is retained within the EFL housing. As best seen in FIGS. 5 and 6, electrical wires extend from the quick connect 74, through the passage 93 in the bottom of the base portion 82, down the duct finger portion 81, and to the temperature sensor/switch component 60. The component 60 also includes a reset button 62 that may be manually pressed to reset the switch 56 after it has switched to an open circuit position. The reset button 62 is adjacent to the pushbutton shaft 90 when the EFL is fully assembled. Accordingly, if the top of the pushbutton shaft 90 is pressed, the bottom of the pushbutton shaft is forced against the reset button 62, and the switch 56 is thereby closed.

When installing the actuator assembly in an HVAC system, a technician first mounts the actuator 20 in proximity of the damper 24 such that the motor/damper interface 26 of the actuator 20 is coupled to the damper control 25. Next, the EFL 52 is mounted on an air duct of the HVAC system such that the base portion 82 of the EFL housing 80 is on the exterior or interior of the duct and the duct finger 81 extends into the interior of the duct. With the actuator 20 and EFL 52 in place, the technician takes the actuator leads 68, 69 and associated quick connect 64, and simply plugs the actuator quick connect 64 into the complementary EFL quick connect 74 secured within the conduit acceptor 95 of the EFL housing 80. When the quick connects 64 and 74 snap into place, the quick connects are secured together, and an electrical connection is established between the actuator 20 and the EFL 52. With this arrangement, there is no need for the technician to spend time stripping lead wires or trying to make a difficult connection in a cramped space.

Figure 9:
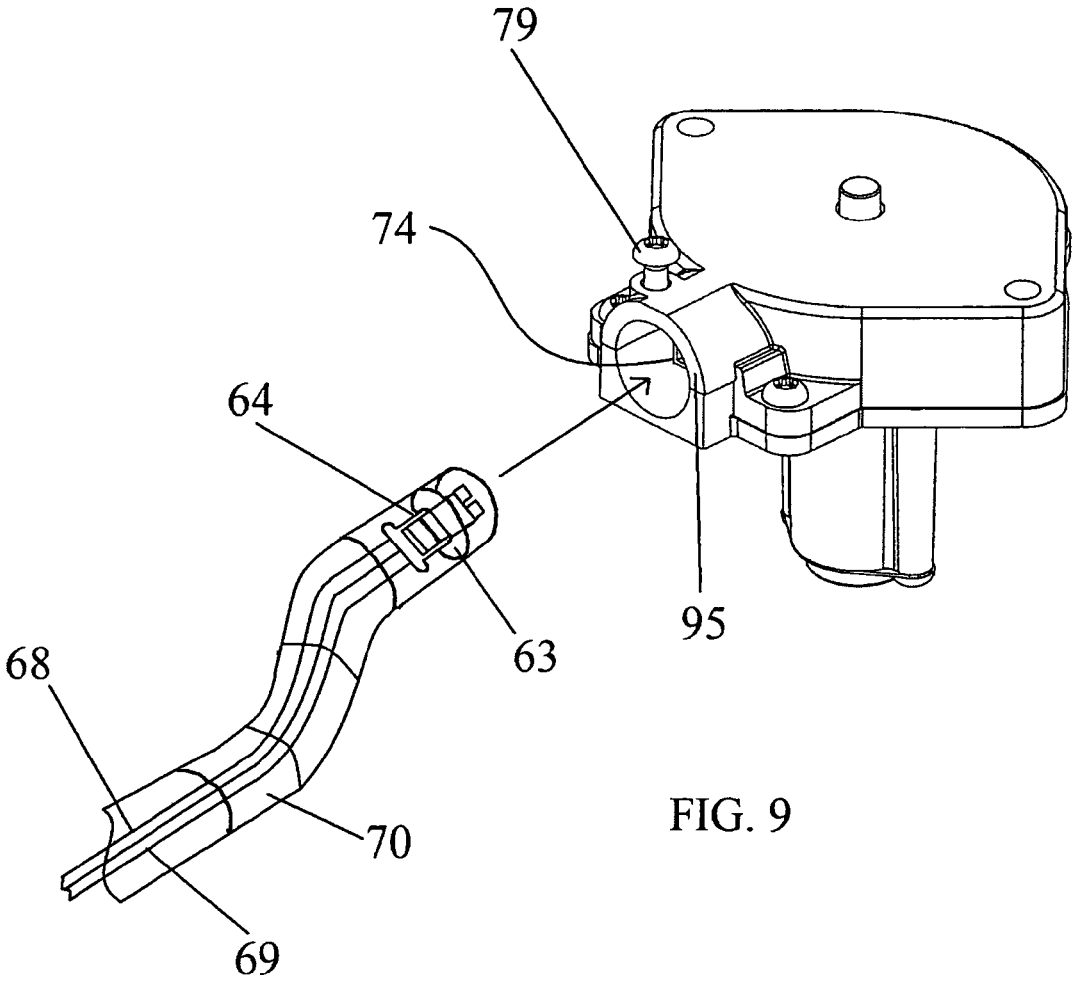
FIG. 9 shows a perspective view of an actuator lead and flexible conduit in relation to the EFL of FIG. 5.

In one embodiment shown in FIG. 9, the actuator leads 68, 69 are covered by a flexible conduit material 70 that extends from the actuator housing along with the leads. An example of such conduit material is ⅜" flexible metal conduit ABR-10 from Electri-Flex Co. of Roselle, Ill. In this embodiment of FIG. 9, the quick connect 64 is generally secured to a retainer wall 63 on the end of flexible conduit. With the quick connect 64 secured to the retainer wall 63, the technician simply plugs the flexible conduit 70 into the conduit acceptor 95 of the EFL until the actuator quick connect 64 snaps into the complimentary EFL quick connect 74. At the same time, the end of the flexible conduit material seats snugly into the integral conduit acceptor 95, and is secured by tightening screws 79 into the flexible conduit material and EFL and providing a continuous covering for the leads 68, 69 between the actuator and the EFL.

Although the present invention has been described with respect to certain preferred embodiments, it will be appreciated by those of skill in the art that other implementations and adaptations are possible. For example, elongated leads could extend from the EFL rather than the actuator and the integral conduit acceptor could be provided on the actuator rather than the EFL. In another example, elongated leads could extend from both the EFL and the actuator and the quick connects could be joined apart from the EFL and actuator housings. Moreover, there are advantages to individual advancements described herein that may be obtained without incorporating other aspects described above. Therefore, the spirit and scope of the appended claims should not be limited to the description of the preferred embodiments contained herein.

What is claimed is:

1. A damper actuator assembly comprising:

a) an actuator comprising an actuator housing, and at least one actuator lead extending from the actuator housing, and a first quick connect attached to the at least one actuator lead; and b) an electronic fusible link (EFL) comprising (i) an EFL housing including a conduit acceptor configured to removably accept therein an end of a flexible conduit positioned around the at least one actuator lead, at least a portion of the EFL housing being configured for insertion into a duct for air ventilation (ii) EFL circuitry positioned in or on the EFL housing, the EFL circuitry including a switch and an EFL lead extending from the switch to the integral conduit acceptor of the EFL housing, and (iii) a second quick connect attached to the EFL lead, the first quick connect being configured to securely engage the second quick connect and establish an electrical connection between the actuator lead and the EFL lead at the conduit acceptor of the EFL housing.

2. The damper actuator assembly of claim 1 wherein the conduit acceptor includes a quick connect seat and the second quick connect is mounted in the quick connect seat.

3. The damper actuator assembly of claim 1 wherein the actuator further comprises power supply circuitry, motor control circuitry, and a motor, and wherein the actuator lead is connected to the motor control circuitry.

4. The damper actuator assembly of claim 1 wherein the EFL circuitry comprises a temperature sensor.

5. The damper actuator assembly of claim 4 wherein the EFL circuitry further comprises a switch connected to the temperature sensor and wherein the EFL lead extends from the switch.

6. The damper actuator assembly of claim 4 wherein the EFL housing comprises a base portion and a duct finger extending from the base portion, the duct finger being configured for insertion into the duct for air ventilation, and wherein the integral conduit acceptor is formed in the base portion, and the temperature sensor is positioned on the duct finger.

7. The damper actuator assembly of claim 1 wherein the conduit acceptor is integral with the EFL housing.

8. A damper actuator assembly for controlling a ventilation damper between an open position and a closed position, the damper actuator assembly comprising:

a) a first housing;

b) a motor positioned in the first housing, the motor configured to control the ventilation damper between the open position and the closed position;

c) actuator circuitry positioned in the first housing and connected to the motor, the actuator circuitry including an actuator lead including a first quick connect on an end of the actuator lead;

d) a second housing separate from the first housing, at least a portion of the second housing being configured for insertion into a duct of the ventilation damper; and e) electronic fusible link (EFL) circuitry positioned in or on the second housing, the EFL circuitry including a temperature sensor and an EFL lead, the EFL lead including a second quick connect on an end of the EFL lead which is fixedly mounted in a passage in the second housing that extends from an interior to an exterior of the second housing, wherein the second quick connect is configured to engage the first quick connect within the passage and establish an electrical connection between the actuator lead and the EFL lead; and wherein at least one of the first quick connect or the second quick connect includes a snap tab.

9. The damper actuator assembly of claim 8 wherein the actuator lead extends from the first housing.

10. The damper actuator assembly of claim 8 wherein the passage in the second housing includes a conduit acceptor configured to receive a conduit with the actuator lead positioned in the conduit, and wherein the EFL lead extends to the conduit acceptor such that the second quick connect is positioned in the conduit acceptor when fixedly mounted in the passage of the second housing.

11. The damper actuator of claim 10 wherein the conduit acceptor is integral with the second housing.

12. The damper actuator assembly of claim 8 further comprising power supply circuitry and motor control circuitry connected to the motor, and wherein the actuator lead is connected to the motor control circuitry.

13. The damper actuator assembly of claim 8 wherein the EFL circuitry further comprises a switch connected to the temperature sensor with the EFL lead extending from the switch.

14. The damper actuator assembly of claim 8 wherein the actuator circuitry includes low voltage circuitry and the EFL circuitry is designed to interrupt power in the low voltage circuitry.

15. The damper actuator assembly of claim 8 wherein the second housing comprises a base portion with a duct finger extending from the base portion, wherein the temperature sensor is positioned on the duct finger.

16. The damper actuator assembly of claim 8 wherein the second housing includes a quick connect seat and the second quick connect is retained within the quick connect seat.

17. A damper actuator assembly comprising:

a) an actuator having a first power input for receiving power for operating actuator circuitry, the actuator circuitry including at least a first circuit and a motor circuit operably coupled to the first power input, the actuator including an actuator housing, at least one actuator lead extending from the actuator circuitry to an exterior of the actuator housing, a first quick connect attached to the at least one actuator lead, and a flexible conduit positioned around the at least one actuator lead; and b) an electronic fusible link (EFL) disposed external to the actuator housing and comprising (i) an EFL housing including a conduit acceptor configured to removably accept therein an end of the flexible conduit, at least a portion of the EFL housing being configured for insertion into a duct for air ventilation (ii) a switch coupled to operably disconnect power from the motor circuit without disconnecting the first power input, and (iii) a second quick connect positioned in the conduit acceptor, the second quick connect configured to securely engage the first quick connect and establish an electrical connection between the at least one actuator lead and the switch when the end of the flexible conduit is positioned in the conduit acceptor.

18. The damper actuator assembly of claim 17, wherein the switch is coupled to operably disconnect power from the motor circuit without disconnecting the first circuit.

* * * * *